US005613860A

United States Patent [19]

Banakis et al.

[11] Patent Number: 5,613,860

[45] Date of Patent: Mar. 25, 1997

[54] UNIVERSAL GROUNDING CLIP FOR CARD-RECEIVING CONNECTOR

[75] Inventors: Emanuel G. Banakis, Naperville; Frank A. Harwath, Downers Grove; Richard A. Hays, Montgomery; Kenneth F. Janota, Lisle; Harold K. Lang, Fox River Grove, all of Ill.

[73] Assignee: Molex Incorporated, Lisle, Ill.

[21] Appl. No.: 355,794

[22] Filed: Dec. 14, 1994

[51] Int. Cl.[6] ..... H01R 9/09

[52] U.S. Cl. ..... 439/64; 439/541.5; 439/101

[58] Field of Search ..... 439/59, 64, 78, 439/79, 92, 101, 80, 83, 377, 444, 541.5, 638, 640

[56] References Cited

U.S. PATENT DOCUMENTS

| | | | |
|---|---|---|---|
| 5,290,174 | 3/1994 | Woratyla et al. | 439/541.5 X |
| 5,297,966 | 3/1994 | Brennian, Jr. et al. | 439/64 |
| 5,299,946 | 4/1994 | Kusakabe | 439/159 |
| 5,308,251 | 5/1994 | Kaufman et al. | 439/64 |

FOREIGN PATENT DOCUMENTS

| | | |
|---|---|---|
| 0406610 | 1/1991 | European Pat. Off. . |
| 6162282 | 6/1994 | Japan . |
| WO9317471 | 9/1993 | WIPO . |
| WO9414306 | 6/1994 | WIPO . |

OTHER PUBLICATIONS

AMP Catalog 65701 (Rev. Nov. 1993) p. 13 Entitled: Ejector Assembly for Stacked Standard Profile Pin Headers.

DuPont Customer Drawing Entitled: 68 Position Double Deck Type – I/II/III Top Mount Right E–Button Ejector, p. 1/2.

*Primary Examiner*—Khiem Nguyen

*Attorney, Agent, or Firm*—Stacey E. Caldwell

[57] ABSTRACT

A universal grounding clip is provided for a card-receiving connector which is mounted on a printed circuit board. The connector includes a generally U-shaped housing having guide arms adapted to guide the outside edges of a PC card into mating engagement with the connector. The PC card includes grounding contacts along the outside edges of the card. The universal grounding clip is mounted on each guide arm and includes a contact portion on an inside surface of the respective guide arm for engaging the corresponding grounding contact at the edge of the PC card during insertion of the card and discharging static electricity from the card prior to complete mating of the card and connector. A grounding pad on the grounding clip is provided along a bottom surface of the respective arm and is adapted to be electrically coupled to a ground circuit on the printed circuit board. A grounding pad is also provided along a top surface of the arm for engaging a bottom ground portion of a top stacked connector. The grounding pads of the grounding clip are cut-away to allow a fastening device to pass through the guide arm and to fit within a recess in the guide arm so as not to extend beyond the upper surface thereof.

8 Claims, 4 Drawing Sheets

UNIVERSAL GROUNDING CLIP FOR CARD-RECEIVING CONNECTOR

FIELD OF THE INVENTION

This invention generally relates to the art of electrical connectors and, particularly, to a grounding clip on a PC card-receiving connector for grounding the card to a ground circuit of a printed circuit board.

BACKGROUND OF THE INVENTION

Generally, PC cards, such as memory cards, are data input devices which are electrically connected to personal computer or other electronic apparatus. The data stored in the PC card is transferred to the electronic apparatus. Memory cards are portable instruments which are readily inserted and extracted from a connector mounted in a stationary device which may be used with the PC card for removably coupling the PC card to a printed circuit board in said stationary device, for instance.

One of the problems in manufacturing PC cards as described above involves the build-up of electrical charges in the PC card. Specifically, charges are generated in the PC card during handling since the card generally is a portable instrument often carried on a human body. When a card bearing charges is inserted into an electronic apparatus or the connector thereof, the charges flow to the electronic apparatus through the connecting terminals of the connector. The charges can result in damage to or ultimate failure of the internal integrated circuits or other circuit elements on the card as well as the electronic apparatus itself.

Consequently, structures have been embodied in PC cards and the mating card-receiving connectors for removing static electrical charges stored in the cards. The card typically is grounded to the card-receiving connector. To facilitate grounding and to provide effective static protection, PC cards have been provided with conductive grounding contacts for engaging appropriate grounding elements such as clips or terminals on the card-receiving connector. In fact, with the recent standardization of memory card-receiving connectors, the grounding contacts on the PC card (and the grounding clips of the connector) are provided at fixed locations along the outside edges thereof.

Although some memory card grounding contacts are electrically coupled to conductive trays or plates which, in turn, are connected to the grounding clip of the card-receiving connector, it is electrically more desirable to have as direct a ground connection as possible between the card grounding contact and the ground circuit of the underlying circuit board. Therefore, grounding clips have been developed for the card-receiving connector which include a card-engaging contact portion located on an inside surface of the guide arms of the connector for directly electrically engaging the memory card as it is inserted into mating engagement with the card-receiving connector. The grounding element further includes a board-engaging ground portion for engaging the grounding circuit of the underlying circuit board. Moreover, since fastening devices (such as solder tails, interference fit boardlocks or screws) are used to secure the guide arms of the connector to the underlying circuit board, some grounding clips have been coupled to or incorporated in the fastening devices themselves so that the grounding clip is electrically coupled to the ground circuit of the underlying circuit board (by way of the conductive fastening device), while at the same time securing the guide arms thereto. Screws equipped with nuts have generally been the fastening device most often employed due to their removable nature and reliability.

In the case of stacked or "dual port" card-receiving connectors, the design of the grounding clip becomes more complicated since the upper card-receiving connector must also be electrically coupled to the ground circuit of the underlying board. Some grounding clips have been uniquely designed for dual port card-receiving housings, however these designs necessitate separate dies and separate assembly equipment when the dual portion applications are utilized. Some grounding clips for dual port connectors have been designed for the lower card-receiving connector with an upper ground portion (on an upper surface of the guide arm integral with the card-engaging contact portion of the clip) for electrically engaging the lower ground portion of the upper card-receiving connector. However, the same clip cannot easily be adapted for use on the upper card-receiving connector since the upper ground portion must allow the fastening device to pass therethrough so it does not extend above the upper surface of the guide arms. Accordingly, grounding clips have been uniquely configured for the upper and the lower as well as for the right and the left grounding locations, since the clip is typically asymmetrical. See, for example, the prior art grounding clip shown in FIG. 1.

Therefore, it is logistically and economically desirable to provide a single grounding clip and utilize it in any or all grounding locations of both single and dual port connectors, including top, bottom, left and right grounding locations. Such a universal grounding clip would avoid the added costs associated with changeover die inserts, inventory, and assembly of each separate part. The present invention is directed to providing such a universal grounding clip.

SUMMARY OF THE INVENTION

An object, therefore, of the invention is to provide a new and improved grounding clip for use in a card-receiving connector which receives a PC card.

In the exemplary embodiment of the invention, the card-receiving connector is a header connector adapted for mounting on a printed circuit board, and the PC card has grounding contacts along the outside edges thereof. The header connector includes a generally U-shaped housing having guide arms for receiving the PC card therebetween. The guide arms form legs of the U-shape and are adapted to guide the card along the outside edges thereof. A grounding clip is mounted on each guide arm and includes a contact portion on the inside of the arm for engaging the respective grounding contact at one edge of the PC card to discharge static electricity from the card prior to complete mating of signal contacts of the PC card and the header connector. The grounding clip includes a grounding pad along the bottom surface of the arm adapted to be electrically coupled to a ground circuit on the printed circuit board. A fastening device extends through each guide arm and secures the connector to the printed circuit board.

The invention contemplates that the grounding clip be constructed as a universal structure for mounting on either guide arm, without modification, and including a grounding pad along a top surface of the respective guide arm. Both top and bottom grounding pads are cut-away to allow the fastening device to pass therethrough and to allow the fastening device to sit within a recess in its respective guide arm without extending past the upper surface thereof.

The invention contemplates that the universal grounding clips facilitate the stacking of two card-receiving connectors defining a "dual port" connector assembly. The universal grounding clips can be used on either or both guide arms of both stacked connectors, with the fastening means extending entirely therethrough, and with the ground portions of the grounding clips providing a ground circuit path from the top connector through the bottom connector and to the ground circuit of the underlying printed circuit board.

In the preferred embodiment of the invention, the universal grounding clip is stamped and formed of sheet metal material, and the grounding pads thereof are maintained substantially flush with the top and bottom surfaces of the respective guide arm. The card-engaging contact portion of each grounding clip is provided by a resilient cantilevered spring contact arm.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
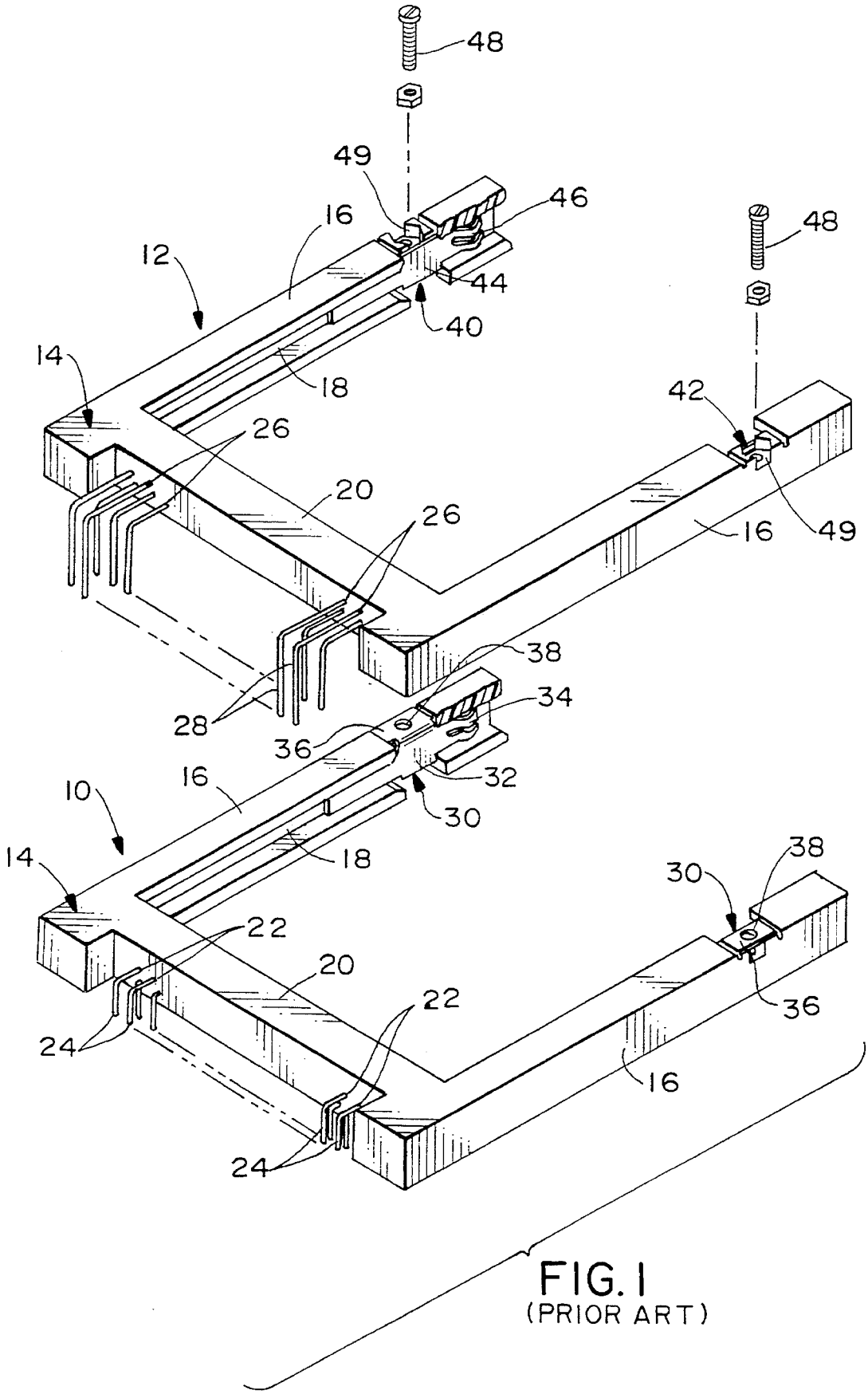
FIG. 1 (PRIOR ART)
FIG. 1 is a perspective view of a pair of stackable card-receiving connectors for receiving a pair of PC cards, according to the prior art.

Referring to the drawings in greater detail, and first to FIG. 1, a pair of card-receiving connectors, specifically depicted as header connectors and generally designated 10 and 12, are illustrated and employ grounding clips according to the prior art. The connectors are adapted for receiving a pair of PC cards to provide a "dual port" card-receiving connector assembly. The bottom connector 10 shown in FIG. 1 is adapted for mounting on a printed circuit board (not shown), and the top connector 12 is adapted for stacking on top of the bottom connector.

More particularly, each connector 10 and 12 in FIG. 1 includes a generally U-shaped housing 14 having a pair of guide arms 16 for receiving a respective PC card therebetween. The housing is unitarily molded of dielectric material such as plastic or the like. The guide arms form legs of the U-shaped housing and include inside channels or slots 18 which define an insertion path for guiding each PC card along the outside edges thereof into mating engagement with the header connector. A bight portion 20 of the U-shaped housing spans the legs of the U-shape and define a connector portion of the housing extending between guide arms 16. Connector portion 20 of header connector 10 includes right-angled terminals 22 having tails portion 24 for mounting to appropriate electrical traces of the printed circuit board, and connector portion 20 of header connector 12 has right-angled terminals 26 which have tail portions 28 for mounting to appropriate electrical traces of the printed circuit board. It can be seen that tail portions 28 of terminals 26 are longer than tail portions 24 of terminals 22, because the top connector 12 is spaced further from the printed circuit board than bottom connector 10. Tail portions 24 and 28 may be electrically connected to circuit traces on the printed circuit board via plated through holes or surface mounting.

Figure 2A:
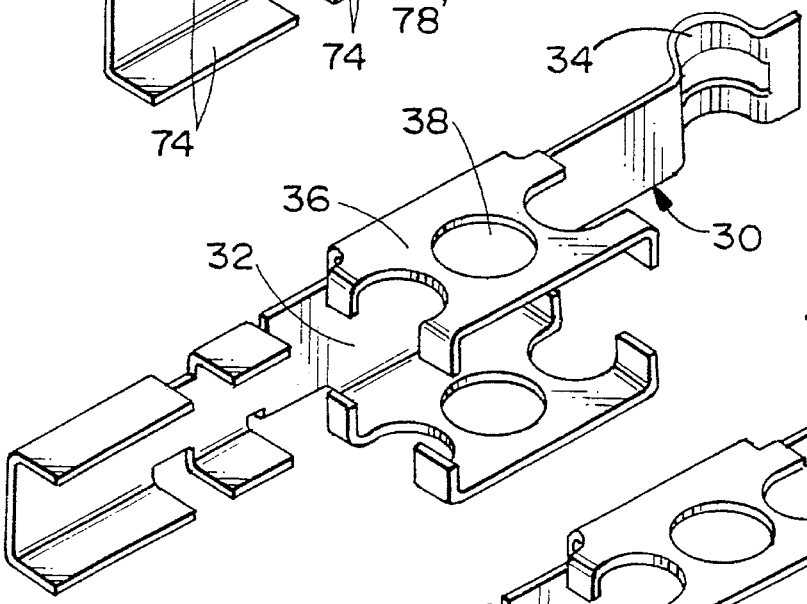
FIG. 2A (PRIOR ART)
FIGS. 2A, 2B and 2C are perspective views of the three prior art ground clips which the single universal grounding clip of the invention replaces.

Looking now to FIG. 2 in conjunction with FIG. 1, as discussed in detail in the "Background", above, in order to discharge static electricity from the PC cards, header connectors 10 and 12 are provided with grounding clips which engage corresponding ground contacts on the PC cards and ground the cards to the ground circuit of the printed circuit board. More particularly, bottom connector 10 of the prior art arrangement shown in FIG. 1 includes a pair of mirror-image grounding clips, shown separately in FIG. 2A and generally designated 30, mounted within channels 18 of guide arms 16. Each grounding clip 30 of the bottom connector includes a generally planar portion 32 within the respective channel and at least one cantilevered spring contact portion 34 for engaging a corresponding grounding contact at the edge of a PC card during insertion of the card into the connector. Generally planar grounding pads 36 are located along a portion of the top and bottom surfaces of guide arms 16, the grounding pads having holes 38 therethrough. The grounding pads 36 are maintained generally flush with the top and bottom surfaces of the guide arms of connector 10. Therefore, the grounding pads on the bottom surfaces of the guide arms are adapted for engaging the ground circuit on the printed circuit board, and the grounding pads on the top surfaces of guide arms 16 are adapted to engage the lower or bottom grounding pads of the grounding clips of top connector 12 as described below.

Figure 2B:
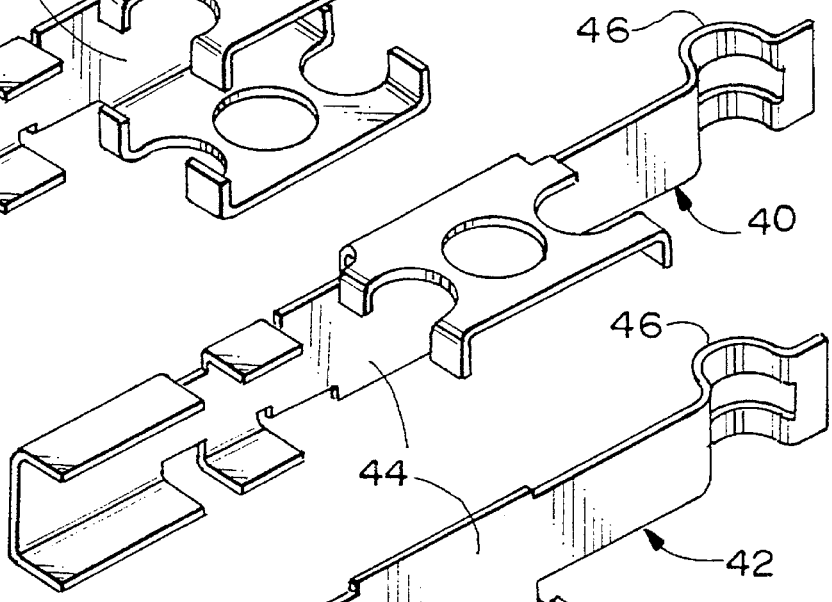
FIG. 2B (PRIOR ART)
Figure 2C:
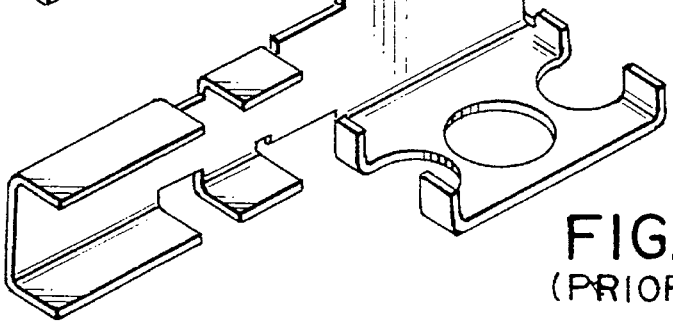
FIG. 2C (PRIOR ART)

Top header connector 12 includes a pair of grounding clips, generally designated 40 and 42 and shown in FIG. 2B and 2C, respectively. These grounding clips are mounted substantially inside channels 18 of guide arms 16, similar to grounding clips 30 of bottom connector 10. Each grounding clip 40 and 42 again includes a generally planar portion 44 inside the respective channel 18 and a cantilevered spring contact portion 46 for engaging a corresponding grounding contact along the edge of the PC card that is inserted into header connector. Both grounding clips 40 and 42 have a grounding pad located along the bottom of the respective guide arm 16 (similar to grounding pads 36 of grounding clips 30) that are substantially flush with the bottom surfaces of the guide arms and which engage grounding pads 36 of grounding clips 30 of bottom connector 10. Therefore, a common ground circuit is established from the PC card which is inserted into top connector 12, through grounding clips 42 and 44, to grounding clips 30 of the bottom connector, and to the ground circuit on the printed circuit board. Grounding clips 40 and 42 have no contact pads at the top surfaces of guide arms 16 to allow for fastening devices in the form of bolts 48 to fit within a recess 49 in guide arms 16 to secure the connectors to the printed circuit board. The bolts extend through holes 38 in grounding pads 36 of the grounding clips of bottom connector 10 and the head of the bolt and/or the nut fits within the recess and corresponds in shape thereto to facilitate assembly and to ensure that no portion of the fastening device extends past the top surface of the upper connector.

From the foregoing, it can be understood that connector assemblies of the prior art as shown in FIG. 1 employ three different configurations of grounding clips, as shown in FIG. 2. Grounding clips 30 (FIG. 2A) are of one configuration and include grounding pads 36 on both the top and bottom surface of the respective guide arm. Therefore, these grounding clips 30 can be mounted on either guide arm 16 of the bottom connector 10. However, top connector 12 employs two differently configured grounding clips 40 and 42 (FIG. 2B and 2C) which are different from grounding clips 30 and which are different from each other. In other words, although grounding clip 32 is a mirror image of grounding clip 40, neither grounding clips 40 nor 42 can be interchanged and mounted on the opposite guide arm 16 of top connector 12 since the clips are asymmetrical. Therefore, three differently configured grounding clips must be maintained in inventory for fabricating the connector assembly shown in FIG. 1 according to the prior art.

Figure 3:
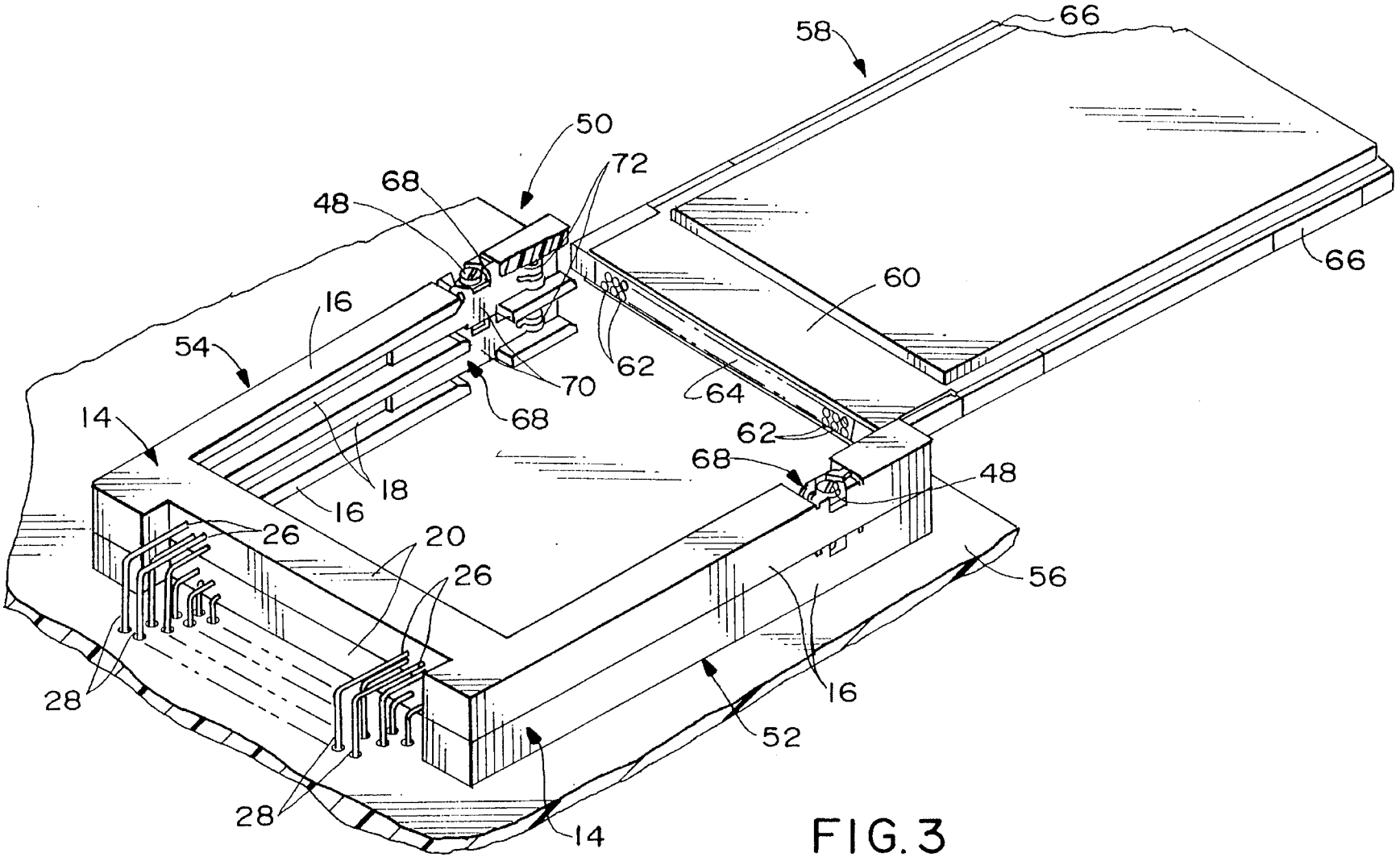
FIG. 3 is a perspective view of a pair of stacked card-receiving connectors mounted on a printed circuit board with the top connector about to receive a PC card, the connectors being according to the present invention.
Figure 4:
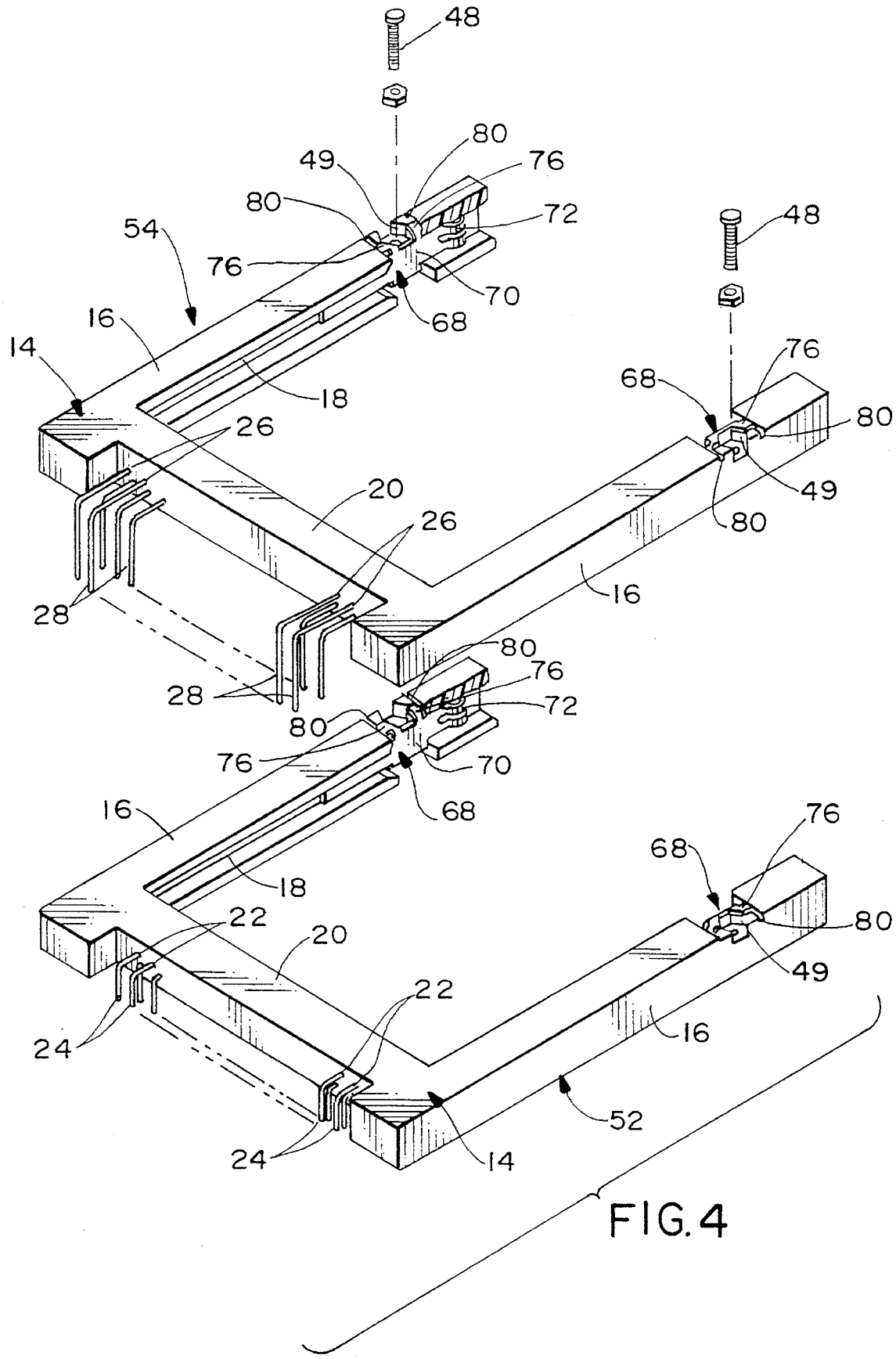
FIG. 4 is a view similar to that of FIG. 1, but with the connectors employing the universal grounding clips of the invention.

FIGS. 3 and 4 show a dual port connector assembly, generally designated 50, which includes a pair of stacked card-receiving connectors, generally designated 54, for receiving two corresponding PC cards (one shown). The bottom connector 52 is adapted for mounting on a printed circuit board 56, and top connector 54 is adapted for stacking onto the bottom connector. Both connectors include generally U-shaped housings substantially identical to housings 14 described above in relation to FIG. 1, and, therefore, like numerals have been applied in FIGS. 3 and 4 corresponding to like components described above in relation to FIG. 1, including guide arms 16, channels 18, connector portions 20, terminals 22 and 26 and tail portions 24 and 28 of the terminals. In addition, fastening means such as bolts 48 are used to secure the stacked connectors to printed circuit board 56.

A PC card, generally designated 58, is shown in FIG. 3 prior to insertion into top connector 54, i.e. between guide arms 16 thereof. Therefore, the PC card is guided within channels 18 of guide arms 16 of the top header connector. Similarly, although not shown in FIG. 3, a similar PC card 58 is insertable into the channels 18 of guide arms 16 of bottom connector 52.

Each PC card 58 includes a front receptacle portion 60 which has receptacle terminals mounted in apertures 62 in a front face 64 of the receptacle for receiving pin portions of terminals 26. Lastly, each PC card 58 includes grounding contacts 66 along opposite edges of the card for engaging universal grounding clips, generally designated 68, according to the invention during insertion of the card into mating engagement with the connector. The grounding clips are mounted on the inside surfaces of guide arms 16 of header connectors 52 and 54.

Figure 5:
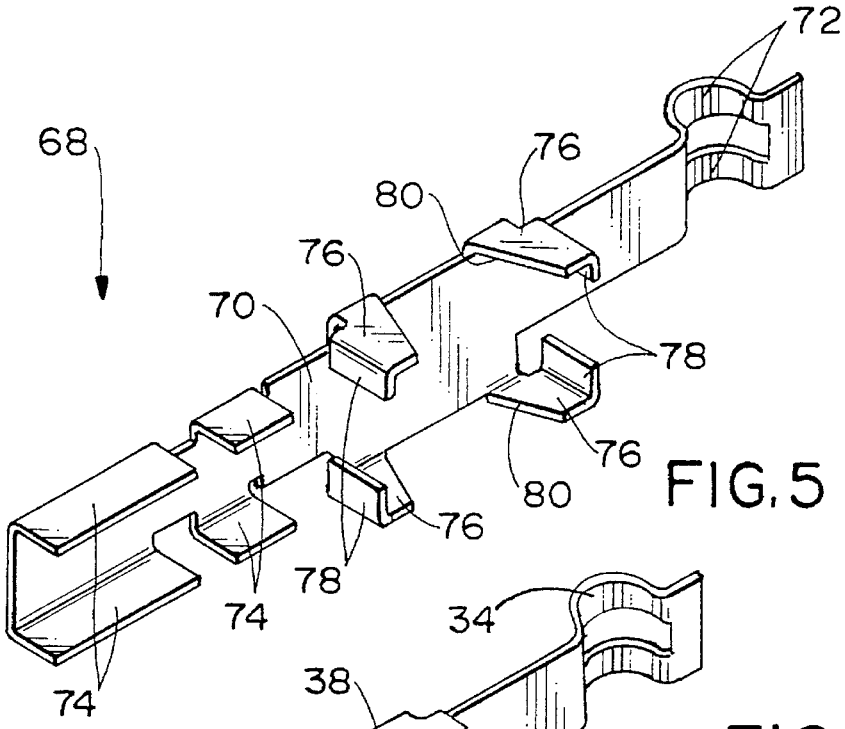
FIG. 5 is a perspective view of one of the universal grounding clips of the invention.

More particularly, referring to FIG. 5 in conjunction with FIGS. 2, 3 and 4, each universal grounding clip 68 includes a generally planar portion 70 that is disposed within channels 18 as is seen in FIGS. 3 and 4. Cantilevered spring contact arm 72 is adapted for contacting grounding contacts 66 at opposite edges of PC card 58 as the PC card is being inserted within the channels 18 of guide arms 16. Stabilizing tabs 74 are positioned within channels 18 of guide arms 16 and serve the dual function of retaining the grounding clip within the channel and forming part of the channel 18 along the initial portion of the PC card insertion path. A pair of spaced grounding pads 76 are provided at both the top and bottom of each grounding clip 68 and are maintained generally flush with the top and bottom surfaces of guide arms 16. Strengthening flanges 78 project inwardly from grounding pads 76 for positioning into grooves 80 in the top and bottom surfaces of guide arms 16 to stabilize and strengthen the grounding pads. Grounding clips 68 are stamped and formed of sheet metal material, and cut-out areas 80 are formed between each pair of grounding pads 76 at the top and bottom of the grounding clip. These cut-away areas provide clearance for the hexagonally-shaped fastening bolts or nuts 48 which secure connectors 52 and 54 in their stacked relationship onto printed circuit board 56.

From the foregoing, it can be understood that a single grounding clip configuration is provided by universal grounding clip 68 for mounting on the inside of either guide arm 16 of either connector 52 or 54. Therefore, only one grounding clip must be fabricated and maintained in inventory as shown in FIG. 5, in contrast to the three differently configured grounding clips 30, 40 and 42 of the prior art connector assembly described above and shown in FIG. 2. The uniquely configured universal grounding clip therefore saves considerable costs in manufacture and assembly of the connectors, as well as in inventory maintenance.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a connector assembly which includes a pair of card-receiving connectors for receiving a pair of PC cards, the PC cards each having grounding contact means along outside edges thereof, the connectors being positioned one on top of the other with the bottom connector adapted for mounting on a printed circuit board, each connector including a generally U-shaped housing having guide arms for receiving one of the PC cards therebetween, the guide arms forming legs of the U-shape and being adapted to guide the respective card along the outside edges thereof into mating engagement with the connector, a grounding clip mounted on at least one of the guide arms and including a resilient contact portion on the inside of the arm for engaging the grounding contact means of the PC card, the at least one grounding clip of the top connector having a grounding pad along a bottom surface of the respective guide arm which engages the grounding clip of the bottom connector, and the at least one grounding clip of the bottom connector having a grounding pad along the bottom surface of the respective guide arm adapted to be electrically coupled to a ground circuit of the printed circuit board, and a fastening device extending through the guide arm of the top connector and an underlying guide arm of the bottom connector to secure the connectors in a stacked relationship to the printed circuit board, wherein the improvement comprises:

said grounding clips being universally adaptable for mounting on either guide arm of either connector, the grounding pads of the grounding clip being cut-away to allow the fastening device to pass therethrough, wherein the grounding pad along the bottom surface of the guide arm of the top connector engages the grounding pad along the top surface of the guide arm of the bottom connector, and the grounding pad along the bottom surface of the guide arm of the bottom connector is adapted to be electrically coupled to the ground circuit of the printed circuit board, whereby a common ground circuit is established between the PC cards, the grounding clip of the top connector, the grounding clip of the bottom connector and the ground circuit of the printed circuit board.

2. In a connector assembly as set forth in claim 1, wherein each guide arm further comprises a recess which surrounds a passageway for receiving a fastening device therethrough, and wherein the grounding pad of the grounding clip is located outside the recess to accommodate the fastening device.

3. In a connector assembly as set forth in claim 2, wherein said fastening device and said recess are correspondingly shaped to allow a top portion of the fastening device to sit within the recess, whereby the fastening device is located substantially entirely below the top surface of the guide arms of the top connector.

4. In a connector assembly as set forth in claim 1, wherein said grounding pads are substantially flush with the top and bottom surfaces of the respective guide arm.

5. In a connector assembly as set forth in claim 1, wherein said contact portion of each grounding clip comprises a cantilevered spring contact arm.

6. In a card-receiving connector for mounting on a printed circuit board and for receiving a PC card which has grounding contacts along opposite edges thereof, the connector including a generally U-shaped housing having guide arms for receiving the PC card therebetween, the guide arms forming legs of the U-shape and being adapted to guide the card along the outside edges thereof into mating engagement with the card-receiving connector, each guide arm including a recess which surrounds a passageway extending through the guide arm, a grounding clip mounted on each guide arm having a contact portion on the inside of the arm for engaging the grounding contact of the PC card thereby discharging static electricity from the card prior to completed mating of the PC card and the card-receiving connector, and a grounding portion along a bottom surface of the arm adapted to be electrically coupled to a ground circuit on the printed circuit board, and a fastening device extending through the passageway of each guide arm to secure the connector to the printed circuit board, a portion of the fastening device lying within the recess surrounding the passageway, wherein the improvement comprises:

said grounding clip being a universal structure for mounting on either guide arm and including a grounding portion on a top surface of the guide arm, each grounding portion being cut-away to allow the fastening device to pass therethrough, wherein the grounding pads of the universal grounding clip are located outside the recess in the guide arms to accommodate the fastening device.

7. In a card-receiving connector as set forth in claim 6, wherein said ground portions are substantially flush with the top and bottom surfaces of the respective guide arm.

8. In a card-receiving connector as set forth in claim 6, wherein said contact portion of each grounding clip comprises a cantilevered spring contact arm.

* * * * *